US006915965B2

(12) United States Patent
Siebert

(10) Patent No.: US 6,915,965 B2
(45) Date of Patent: Jul. 12, 2005

(54) FIRE HOSE FOR SIMULTANEOUSLY DELIVERING FIREFIGHTING LIQUID AND HIGH PRESSURE AIR

(76) Inventor: Dave Siebert, 5443 W. Creedance Blvd., Glendale, AZ (US) 85301

( * ) Notice: Subject to any disclaimer, the term of this patent is extended or adjusted under 35 U.S.C. 154(b) by 200 days.

(21) Appl. No.: 10/108,621

(22) Filed: Mar. 27, 2002

(65) Prior Publication Data

US 2003/0183300 A1 Oct. 2, 2003

(51) Int. Cl.[7] ..... A62B 18/00

(52) U.S. Cl. ..... 239/270; 239/71; 239/266; 239/289; 239/450; 169/5; 169/52; 128/202.13; 128/204.18; 128/205.24; 128/206.28

(58) Field of Search ..... 239/71, 72, 1, 239/266, 269, 270, 289, 450; 169/5, 52, 43; 128/202.13, 201.29, 207.13, 204.18, 206.28, 205.24; 116/200, 205, 264, DIG. 17

(56) References Cited

U.S. PATENT DOCUMENTS

| | | | | | |
|---|---|---|---|---|---|
| 386,751 | A | * | 7/1888 | Loomis | 239/270 |
| 958,427 | A | | 5/1910 | Panian | |
| 1,040,311 | A | | 10/1912 | Halloran | |
| 1,084,958 | A | | 1/1914 | Panian | |
| 1,808,281 | A | * | 6/1931 | Balthazor | 239/270 |
| 4,134,457 | A | | 1/1979 | O'Reilly | |
| 4,165,738 | A | | 8/1979 | Graves et al. | |
| 4,345,654 | A | | 8/1982 | Carr | |
| 4,862,931 | A | * | 9/1989 | Vella | 128/202.13 |
| 4,974,584 | A | | 12/1990 | Goodnoe | |
| 5,095,899 | A | | 3/1992 | Green | |
| 5,163,422 | A | * | 11/1992 | Burgess | 128/200.24 |
| 5,570,685 | A | * | 11/1996 | Turiello | 128/202.13 |
| 5,979,565 | A | | 11/1999 | Wicks et al. | |
| 6,520,178 | B1 | * | 2/2003 | Baker | 128/204.18 |
| 2001/0032892 | A1 | | 10/2001 | Brooks et al. | |

* cited by examiner

*Primary Examiner*—Steven J. Ganey
(74) *Attorney, Agent, or Firm*—Robert D. Atkins; Quarles & Brady Streich Lang LLP

(57) ABSTRACT

An air delivery system, wherein the air delivery system is coupled to a hose delivering water or fire-extinguishing foam, for providing air to emergency workers and disaster victims. The system includes a high-pressure air hose coupled at one end to an air-supply source and adapted to be coupled at a plurality of outlets along the delivery system to bottles capable of containing pressurized air.

21 Claims, 6 Drawing Sheets

FIRE HOSE FOR SIMULTANEOUSLY DELIVERING FIREFIGHTING LIQUID AND HIGH PRESSURE AIR

BACKGROUND OF THE INVENTION

The present invention relates to an air-delivery system, wherein the air-delivery system is coupled to a hose delivering water or fire-extinguishing foam.

Fire and combustion consume oxygen-rich air, replacing the oxygenated air with carbon dioxide, and other toxic and lethal gases. Additionally, the smoke produced by fire can readily fill the lungs, causing rapid asphyxiation. Furthermore, destruction of materials by fire, and the resulting collapse of structures, often produce debris-laden atmospheric conditions, that, even away from the concentration of smoke and fire can fill the lungs with particles, making breathing difficult or impossible. Both the victims of such disasters and emergency workers are subject to death by asphyxiation as a result of such conditions.

Early attempts at providing fresh air to emergency workers did so by providing a breathing tube along the length of a fire hose with the breathing tube's inlet at the end of the fire hose attached to the water source. The breathing tube draws in air from the atmosphere to the emergency worker. However, when smoke or debris are present in the atmosphere surrounding the inlet of the air hose, the air reaching the emergency worker is also contaminated and results in continued hindered breathing. Furthermore, the breathing tube required some type of manual effort to draw the air through the tube.

Now, emergency workers normally carry a self-contained breathing apparatus (SCBA) on their back. However, these self-contained units normally only provide about a fifteen-minute air supply. Prior art devices have attempted to resolve the problem of limited air supply of the breathing apparatus by providing breathing stations throughout a building. But installing multiple stations in every structure or residence is cost-prohibitive and impractical, especially for private residences. Additionally, if the location of the station in the structure is engulfed in flames or collapses, the emergency air-supply becomes unavailable.

Another device that addresses the limited air supply of the SCBA is a single hose used to deliver both water to fight the fire and an emergency air supply to the breathing apparatus. However, these devices have several disadvantages. An emergency worker cannot use the hose to deliver water for dousing flames while at the same time using the hose to deliver air to the breathing mask since the water supply must be shut down while the air supply is being delivered. Second, such an air supply system cannot be used in conjunction with hoses that deliver fire-extinguishing foam or other fire-fighting chemicals because delivering air through the same hose would contaminate the air supply delivered through that hose with such chemicals that are toxic to humans.

Hence, there is a need for a fire hose that can simultaneously deliver fire fighting liquid and an uncontaminated air supply.

SUMMARY OF THE INVENTION

The present invention provides a fire hose capable of delivering firefighting liquid and high pressure air simultaneously. In one embodiment of the present invention, and by way of example only, a first hose adapted to be coupled to a firefighting liquid source provides fire extinguishing liquid. A second hose, coupled to the first hose, provides a high pressure air supply. A connector coupled to the second hose is adapted to be selectively fluidically coupled to a third hose. The third hose can then be coupled to the air tank of a self-contained breathing apparatus to provide a supply of air to refill the air tank, thus providing a fresh supply of air to a human.

Other independent features and advantages of the preferred hose will become apparent from the following detailed description, taken in conjunction with the accompanying drawings which illustrate, by way of example, the principles of the invention.

DETAILED DESCRIPTION OF VARIOUS EMBODIMENTS

Figure 1:
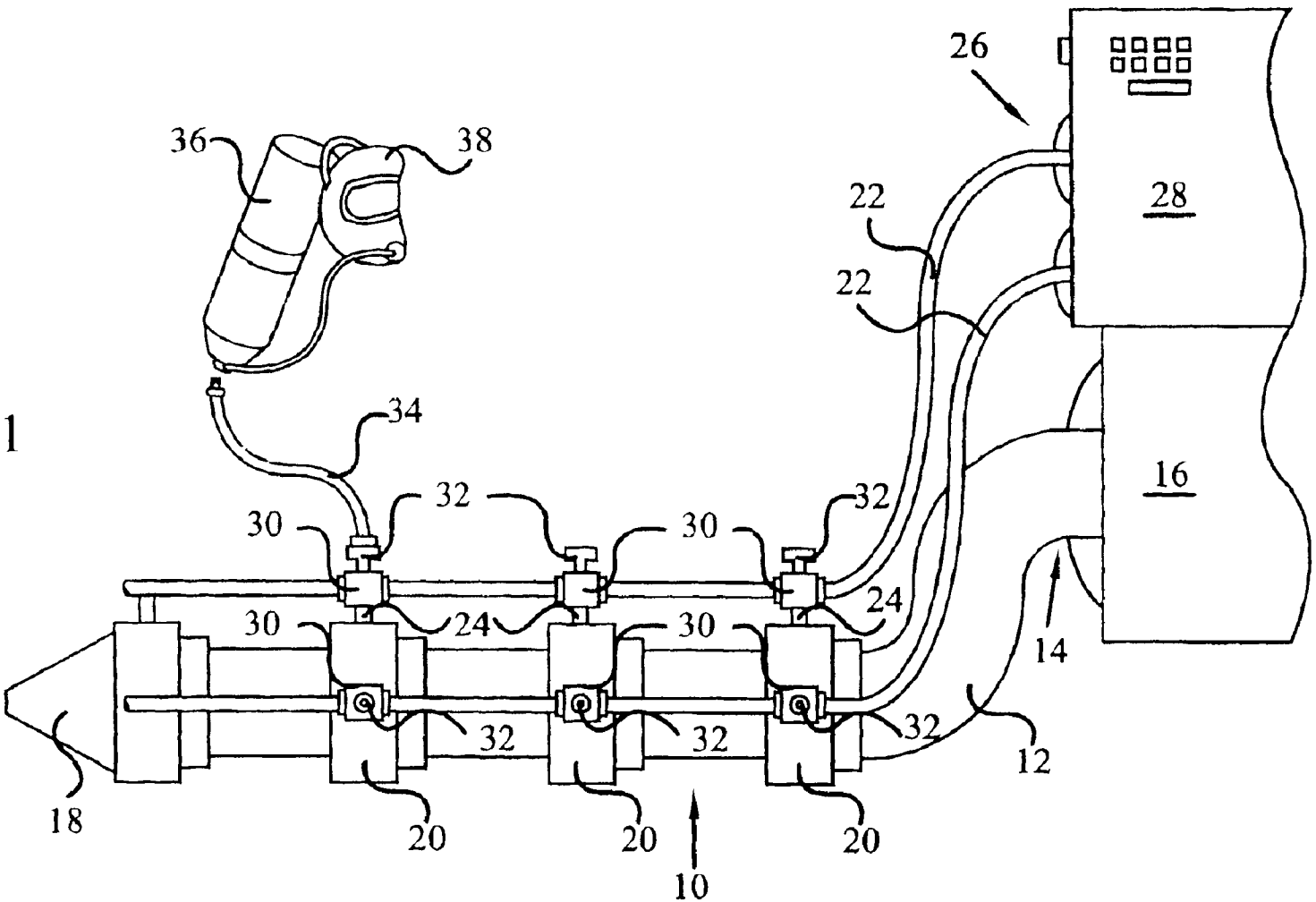
FIG. 1 is a side view of the fire hose with a first hose providing firefighting liquid and a second hose providing high pressure air.

FIG. 1 shows a fire hose 10 capable of delivering firefighting fighting liquid and high pressure air at the same time. Fire hose 10 comprises a first hose, liquid hose 12, capable of delivering firefighting liquid. The firefighting liquid may be water, fire-extinguishing foam, or other liquid firefighting chemical compositions. Liquid hose 12 has an inlet 14 adapted for coupling to a firefighting liquid supply 16, and an outlet adapted to receive a nozzle 18. Liquid hose 12 also comprises a plurality of sections connected by couplings which are preferably male/female fittings, one on each end of the sections of liquid hose 12. Couplings 20 are preferably solid brass water couplings known in the art that are capable of connecting two sections of hose together. Typically, the sections of liquid hose 12 are 50 feet in length. Liquid hose 12 may be any standard firefighting hose known in the art.

Fire hose 10 also comprises one or more air hoses 22, coupled to liquid hose 12. In a preferred embodiment, air hose 22 is coupled to liquid hose 12 using fasteners 24. Fasteners 24 are mounted on couplings 20. Similar to liquid hose 12, air hose 22 may also comprise a plurality of sections. Preferably the sections of air hose 22 are the same length as the sections of liquid hose 12. Air hoses 22 are adapted to be coupled to fasteners 24 at connector 30, holding air hose 22 in place adjacent liquid hose 12. Air hoses 22 can also be adapted to be coupled to liquid hose 12 at the end of a section of the air hose 22, or at other points along the air hoses 22.

The air hoses 22 are each high pressure air supply hoses. Air hoses 22 comprise a flexible hose or line, capable of withstanding an air pressure up to 3000 pounds per square inch or more. In a preferred embodiment, air hose 22 is 5.0 cm in diameter, but other size hoses can be used. Air hose 22 runs the length of the liquid hose 12.

Air hose 22 has an inlet 26 adapted for coupling to a pressurized air source 28, such as an air compressor. Fire trucks are may be equipped with air compressors for use as pressurized air source 28. Pressurized air source 28 preferably supplies uncontaminated, standard quality, air to air hose 22, and preferably includes a regulator to regulate the air pressure of the air flowing through air hose 22. Standard quality breathing air supplied to emergency workers is defined by the National Fire Protection Association (NFPA) Code 1500 §5-3.4.

Air hose 22 has at least one connector 30 at the juncture of at least one section of air hose 22 with a second section of air hose 22. Preferably, two air hoses 22 run from air source 28 along the length of liquid hose 12, though only one or more than two could also be used. At each juncture of liquid hose 12, one or more connectors 30 are mounted on coupling 20, each by a fastener 24. Therefore, at each coupling 20 along liquid hose 12, one or more connectors 30 are present, providing one or more independent air stations, each supplied by its own air hose 22. Therefore, if one air hose 22 becomes impaired and cannot deliver air from pressurized air source 28, a second air hose 22 is available to provide another source of air at the same location along liquid hose 12.

Coupled to each connector 30 is a quick disconnect 32. Quick disconnect 32 is adapted to be coupled to a SCBA hose 34. SCBA hose 34 is any hose known in the art capable of carrying pressurized air. Connector 30 with quick disconnect 32 is adapted to be selectively fluidically coupled to SCBA hose 34. Coupling SCBA hose 34 to connector 30 at quick disconnect 32 causes air to flow from air hose 22 into SCBA hose 34. SCBA hose 34 is also adapted to be coupled on the other end to SCBA tank 36. SCBA tank 36 is any bottle known in the art capable of containing pressurized air. Once SCBA hose 34 is coupled at one end to quick disconnect 32 and at the other end to SCBA tank 36, air flows from air hose 22 to SCBA tank 36, to refill or maintain SCBA tank 36 with air. SCBA tank 36 can then provide a continuous source and supply of uncontaminated air to emergency workers through breathing mask 38.

Figure 2:
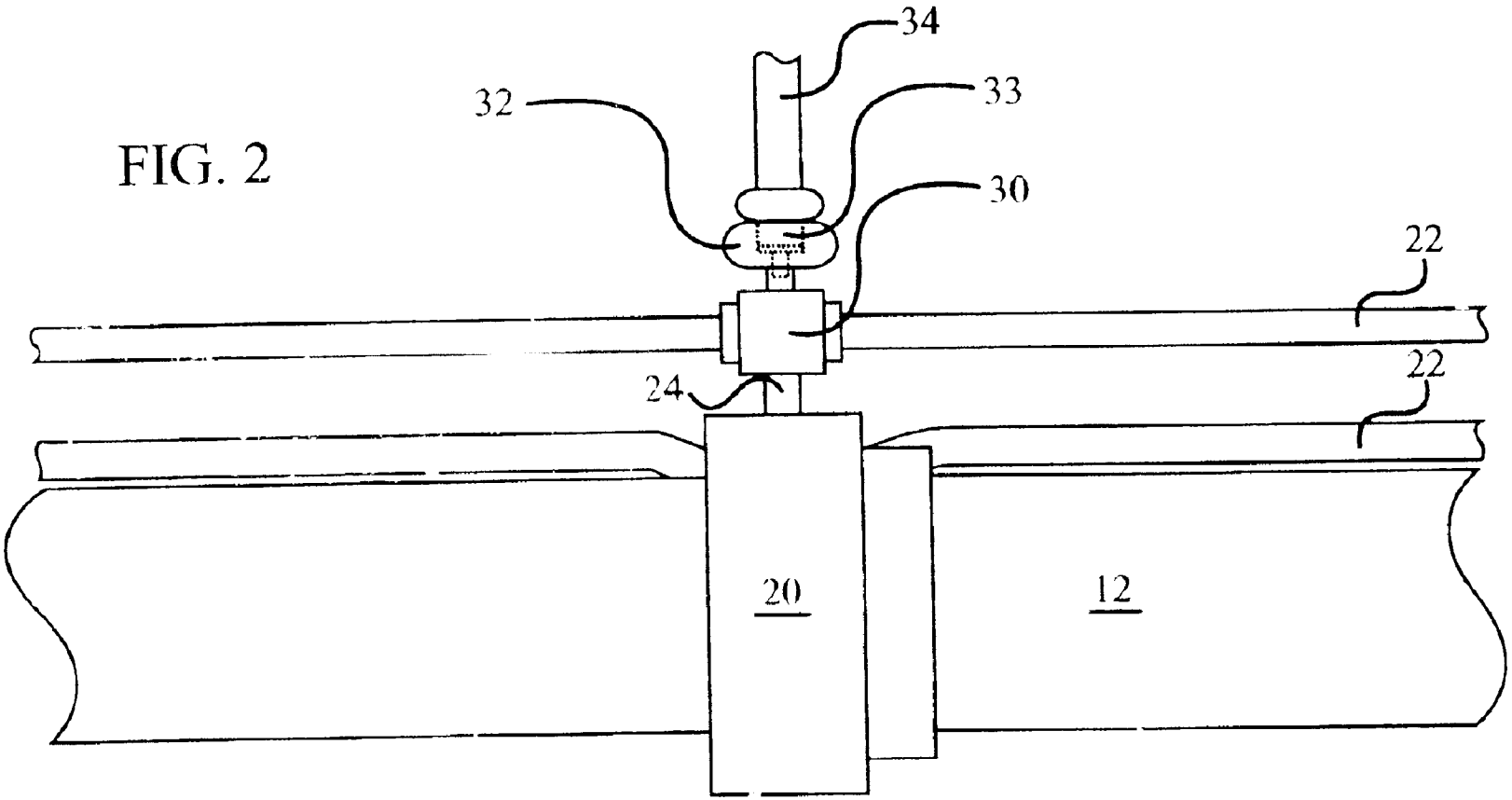
FIG. 2 is a close-up view of a connector of the air hose.

FIG. 2 shows a close-up view of a particular embodiment of connector 30. Connector 30 is adapted to be coupled to coupling 20, preferably by mounting connector 30 on coupling 20 at the end of each section of liquid hose 12 by fastener 24. Fastener 24 is any type of mounting or fastener known in the art that is capable of coupling connector 30 to standard couplings 20 found at the end of each section of liquid hose 12. As is generally known, in some instanes, emergency workers rely on the direction and placement of couplings 20 on standard fire hoses to determine direction and distance from the exit. Therefore, mounting connectors 30 on couplings 20 provides both a stable and easily locatable place for emergency workers to find the outlets for the air supply.

Connector 30 joins sections of air hose 22. Connector 30 also provides a selective outlet for air from air hose 22 by being adapted to be coupled to quick disconnect 32. Quick disconnect 32 may be any quick detachable connector known in the art. Connector 30 is adapted to be coupled to quick disconnect 32 in a manner that will allow air to flow from air hose 22 to a third hose, preferably SCBA hose 34, when the third hose is coupled to quick disconnect 32. Quick disconnect 32 is adapted to be selectively fluidically coupled to SCBA hose 34 by inserting the male end 33 of SCBA hose 34, into quick disconnect 32. Inserting male end 33 of SCBA hose 34 allows air to flow from air hose 12 into SCBA hose 34.

Each connector 30 can also be electrically coupled along air hose 22 to pressurized air source 28. When male end 33 is inserted into quick disconnect 32, an electrical signal may be sent from connector 30 to a transceiver or other circuitry within the pressurized air source 28, or within another piece of equipment, indicating which connector 30 has been activated. Once the male end 33 is removed from quick disconnect 32, the signal ceases. This mechanism provides a way for emergency workers manning pressurized air source 28 to determine where emergency workers are inside a structure and when emergency workers were in need of refilling their SCBA tanks 36.

Figure 3:
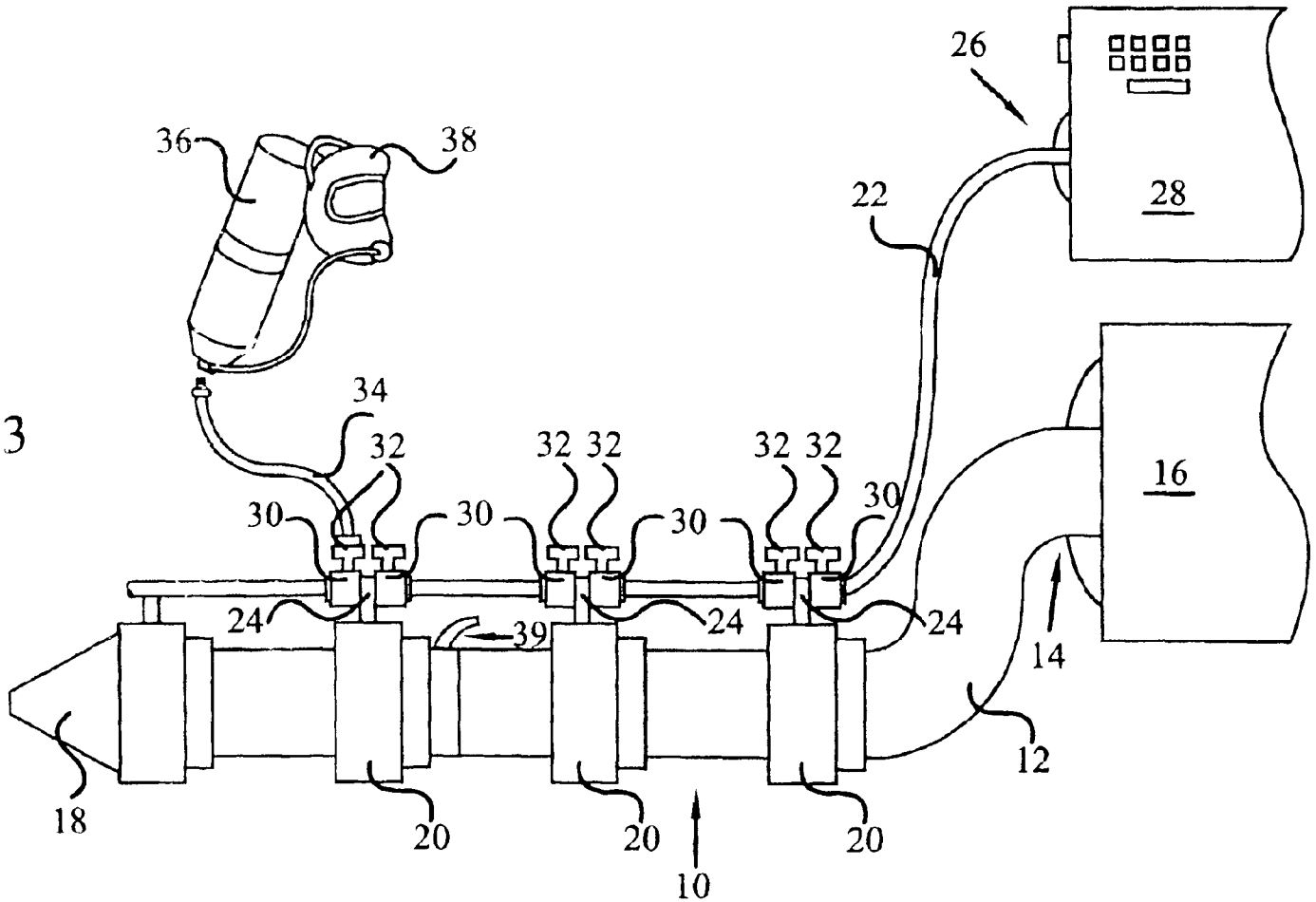
FIG. 3 is a side view of an alternative embodiment of the fire hose.

FIG. 3. shows an alternative embodiment of fire hose 10. In FIG. 3, a single air hose 22 is coupled to liquid hose 12 by fasteners 24. Fastener 24 is mounted on coupling 20. Fastener 24 is capable of coupling to two connectors 30, providing two air stations through one air hose 12 at each coupling 20.

Also illustrated in the alternative embodiment of FIG. 3 is a liquid spout 39. Liquid spout 39 is a quick disconnect for water or other firefighting liquid, preferably a three-eighths inch quick disconnect. Liquid spout 39 is coupled to liquid hose 12 and when the quick disconnect of liquid spout 39 is engaged provides a water source. Liquid spout 39 serves as a cooling mechanism along fire hose 10. A plurality of liquid spouts 39 may be present at intervals along liquid hose 12. Liquid spout 39 may also be adapted to connect to another hose to divert firefighting liquid from liquid hose 12 to cool humans farther from liquid spout 39.

Liquid spout 39 can also be electrically coupled to firefighting liquid source 16. When liquid spout 39 is activated to release firefighting liquid, a signal may be sent from liquid spout 39 to a transceiver or other circuitry within the firefighting liquid source 16, or within another piece of equipment, indicating which liquid spout 39 has been activated. Electrically coupling liquid spout 39 to firefighting liquid source 16 provides a mechanism for emergency workers manning the firefighting liquid source to determined where emergency workers are inside a structure and alert outside workers that someone is in need of cooling.

Figure 4:
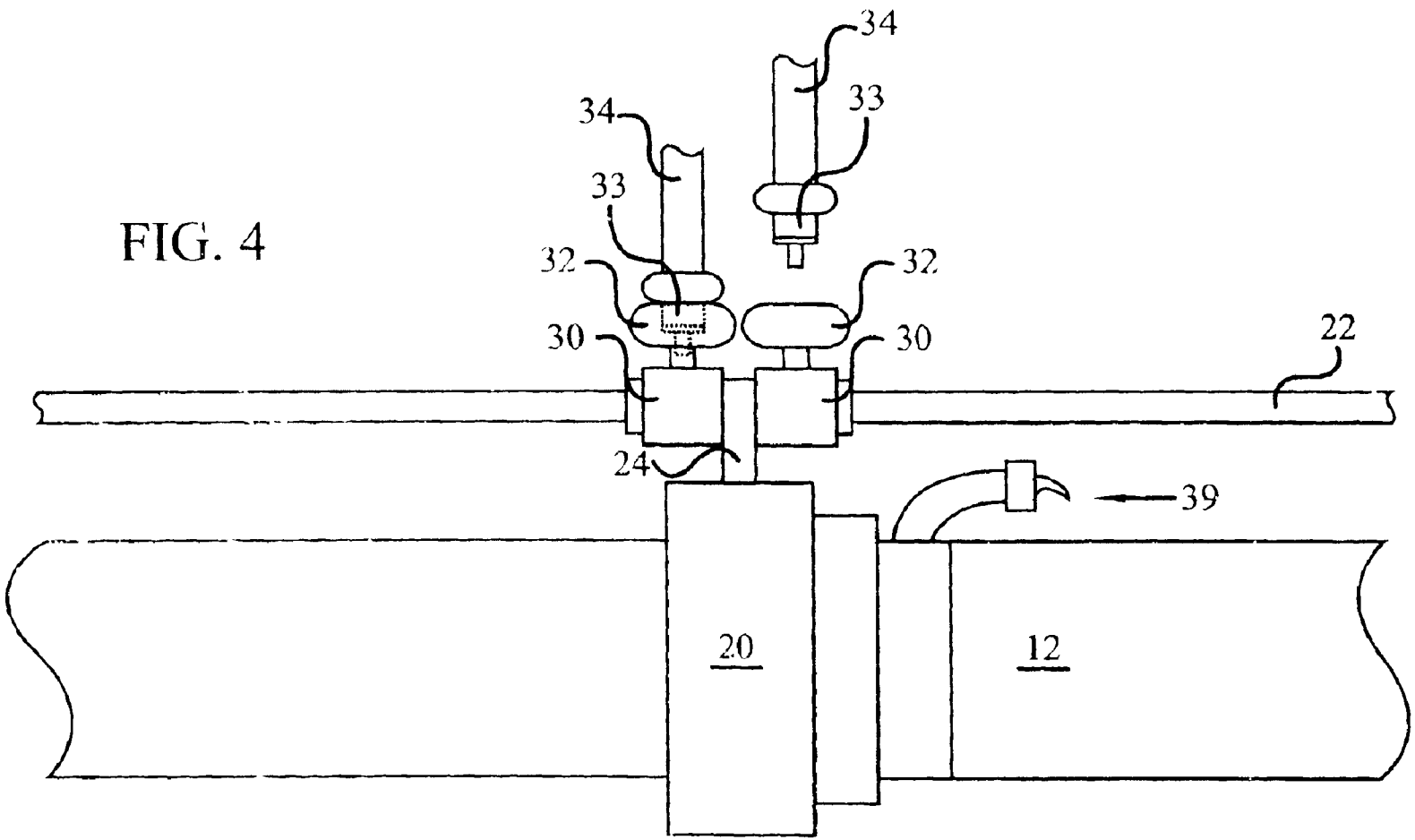
FIG. 4 is a close-up view of connectors of the air hose in the alternative embodiment in FIG. 3.

FIG. 4 shows a close-up view of connectors 30 in the alternative embodiment of FIG. 3. In this alternative embodiment, fastener 24 is adapted to join sections of air hose 22 together. Both ends of a section of air hose 22 are adapted to be coupled to a connector 30. Connector 30 is then adapted to be coupled to fastener 24, joining sections of air hose 22 together. Connector 30 can be coupled to fastener 24 through a threaded screw mechanism, or any other type of air hose coupling known in the art. Connector 30 is also adapted to be coupled to quick disconnect 32, as described above, and provides air to SCBA hose 34 in the same manner.

Figure 5:
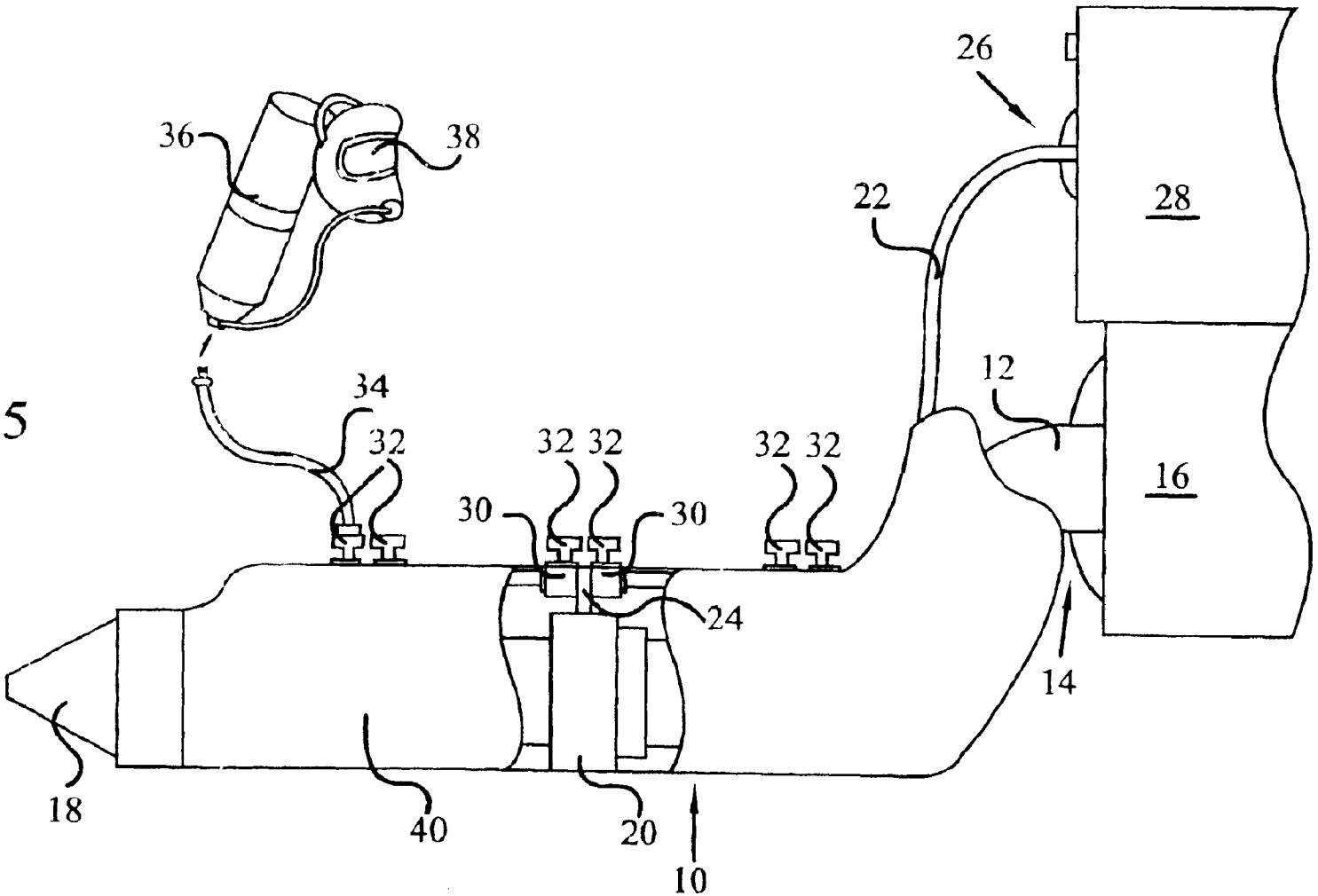
FIG. 5 is an alternative embodiment of the fire hose with both the first hose and the second hose encased in a single sheath of non-flammable material.

FIG. 5 shows an alternative embodiment of fire hose 10. In FIG. 5, fire hose 10 is contained in a continuous sheath 40 of rubber, fire-retardant or non-flammable material. The fire-retardant material is the same type of material used in other firefighting gear, and is constructed around fire hose 10 in the same manner as fire-retardant material encases standard firefighting hoses known in the art. The portion of connector 30, where quick disconnect 32 is coupled to connector 30, projects through an opening in sheath 38, providing access to the air supply. In this embodiment, no fasteners 24 are required, as sheath 40 is sufficient for coupling liquid hose 12 and air hose 22.

Figure 6:
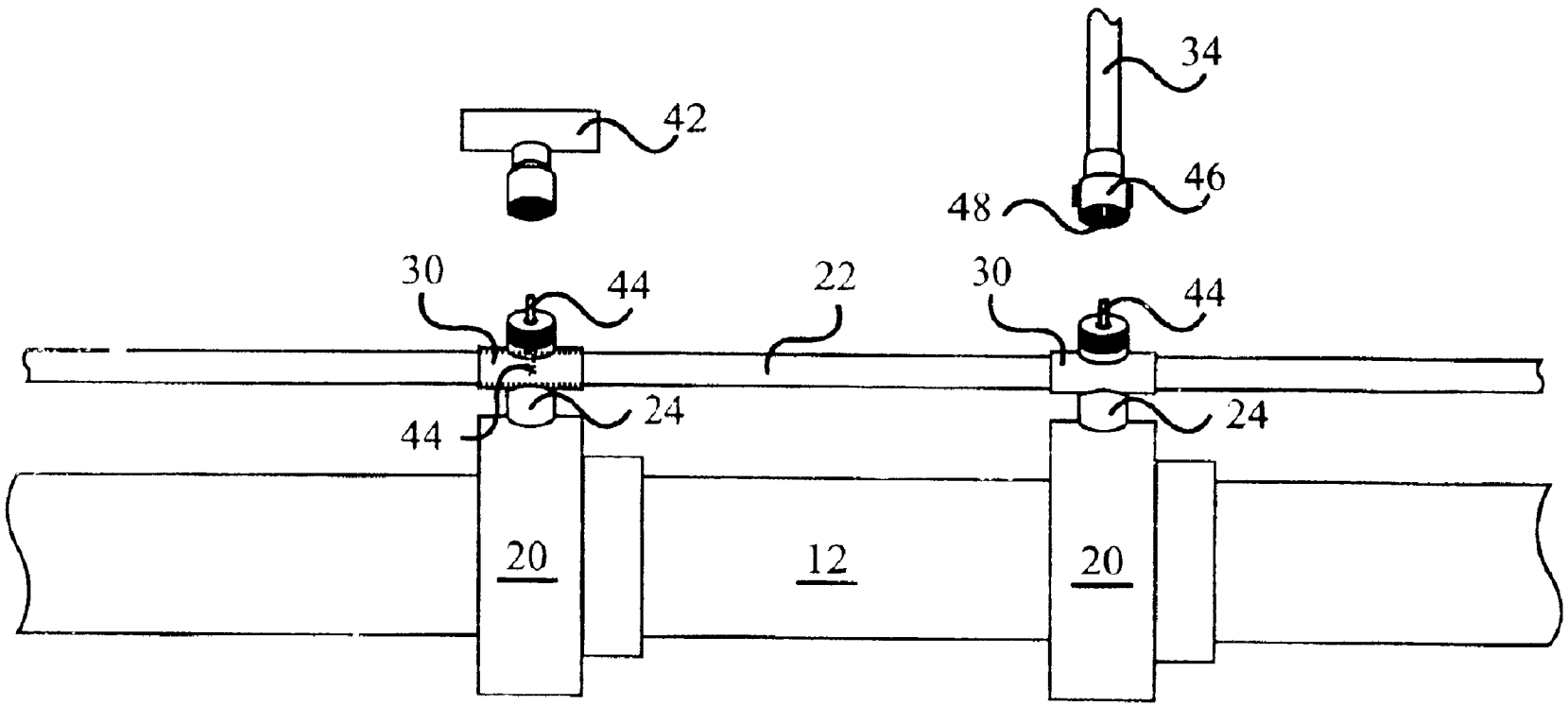
FIG. 6 is an alternative embodiment of a connector of the air hose.

FIG. 6 shows an alternative embodiment of connector 30. Connector 30 is mounted on coupling 20 by fastener 24.

Connector 30 comprises a pipe having a wall thickness of 1.0 cm, and extending 10.0 cm in length with a diameter wide enough to fit around air hose 22. Connector 30 is a coupling, similar to coupling 20, but may be comprised of other types of metal or fire-retardant material. Connector 30 has external screw threads, extending from the upper portion connector 30, used to connect and disconnect SCBA hose 34.

Connector 30 also comprises a stem valve 44 that projects from the inside of air hose 22 to the outside of air hose 22 through the external screw thread projection of connector 30, thus holding stem valve 44 in place. An air-tight seal exists between the air hose 22 outlet and connector 30 at stem valve 44 to prevent air from flowing out of air hose 22, except through stem valve 44. Stem valve 44 provides the means for allowing air to flow out of air hose 22 through connector 30. Other embodiments of connectors 30 with valve-type mechanisms that control air flow from air hose 22 are also envisioned.

When air hose 22 is not being used to supply air to emergency workers, connector 30 is capped with t-cap 42. T-cap 42 has internal screw threads at the connection point and a t-shaped handle constructed with such dimensions so that a human hand can unscrew and remove t-cap 42 from connector 30. Removing t-cap 42 from connector 30 exposes stem valve 44. T-cap 42 is replaced in the same manner when air hose 22 is no longer need to supply air to SCBA tank 36.

SCBA hose 34 also has internal screw threads at connection point 46 where SCBA hose 34 is screwed onto connector 30 over stem valve 44. Projections on the exterior of connection point 46 help provide leverage for human fingers when screwing on SCBA hose 34. When SCBA is screwed onto the external screw threads of connector 30, pin 48 projects into stem valve 44 releasing air from air hose 22, through stem valve 44, causing air to flow from air hose 22 through connector 30 into SCBA hose 34.

When emergency workers deplete their self-contained breathing apparatus, emergency workers can quickly connect to air hose 22 via the above described mechanisms and access a continuous supply of uncontaminated air. Furthermore, emergency workers may, if desired, carry additional breathing masks 38 having SCBA hoses 34, so that emergency workers can also connect disaster victims to SCBA tank 36, providing victims with an uncontaminated air supply as well, without facing the prospect of a limited air supply. Previously, to provide victims with an air supply, an emergency worker would have to either carry additional SCBAs with the heavy air tanks or give up their own breathing mask and SCBA temporarily to provide victims with an air supply. Having the ability to carry an uncontaminated air supply to emergency workers, suffocating victims and victims suffering from smoke inhalation may save numerous lives lost by asphyxiation.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A firefighting system in which a firefighter utilizes a portable pressurized tank for life support while fighting a fire, comprising;

a first hose for transporting a firefighting compound to extinguish the fire;

a second hose mounted external to the first hose along an entire length of the first hose for transporting pressurized gas; and a plurality of quick release connectors coupled to respective exit points along the second hose and spaced apart at predetermined intervals substantially along an entire length of the first hose incident to a zone of fire, wherein the firefighter is able to connect to any one of the plurality of quick release connectors for receiving the pressurized gas from the second hose at sufficient pressure to fill the portable pressurized tank without leaving the zone of fire.

2. The firefighting system of claim 1, further including a sheath to encase the first hose and the second hose.

3. The firefighting system of claim 2, wherein the sheath is made of non-flammable material.

4. The firefighting system of claim 2, wherein the sheath made of rubber.

5. The firefighting system of claim 1, further including a third hose for coupling the portable pressurized tank to the second hose.

6. The firefighting system of claim 1, further including a transceiver electrically coupled to the plurality of quick release connectors for receiving a connector-dependent signal activated by connecting the portable pressurized tank to one of the plurality of quick release connectors, wherein the connector-dependent signal indicates the one of the plurality of quick release connectors to which the portable pressurized tank is connected.

7. The firefighting system of claim 1, wherein each of the plurality of quick release connectors further include a plurality of independent stations, the firefighter being able to connect to any one of the plurality of independent stations.

8. A firefighting system for filling portable pressurized tanks used for life support while fighting a fire, comprising:

a first hose for transporting a firefighting compound;

a conduit for transporting pressurized gas; and a plurality of connectors coupled to exit points along the conduit and spaced apart substantially along a length of the first hose, wherein the portable pressurized tank is connectable to each one of the plurality of connectors for receiving the pressurized gas from the conduit at sufficient pressure to fill the portable pressurized tank.

9. The firefighting system of claim 8, wherein the plurality of connectors further include a quick release mechanism to allow the portable pressurized tank to quickly disconnect from the conduit.

10. The firefighting system of claim 8, further including a sheath to encase the first hose and the second hose.

11. The firefighting system of claim 10, wherein the sheath is made of non-flammable material.

12. The firefighting system of claim 8, wherein each of the plurality of connectors further include a plurality of independent stations, a firefighter being able to connect to one of the plurality of independent stations.

13. The firefighting system of claim 8, further including a third hose which is adapted to couple the portable pressurized tank to the conduit.

14. In a firefighting system, a firefighter using a portable pressurized tank for life support while fighting a fire, comprising:

a first hose for transporting a firefighting compound;

a second hose disposed along an entire length of the first hose for transporting pressurized gas;

a plurality of connectors coupled to exit points spaced apart along the second hose, wherein the firefighter is able to connect the portable pressurized tank to one of the plurality of connectors; and a transceiver electrically coupled to the plurality of connectors for receiving a connector dependent signal activated by connecting the portable pressurized tank to one of the plurality of connectors, wherein the connector-dependent signal indicates the one of the plurality of connectors to which the portable pressurized tank is connected.

15. The firefighting system of claim 14, further including a sheath to encase the first hose and the second hose.

16. The firefighting system of claim 14, wherein the plurality of connectors further include a quick release mechanism to allow the portable pressurized tank to quickly disconnect from the second hose.

17. The firefighting system of claim 14, wherein each of the plurality of connectors further include a plurality of independent stations, the firefighter being able to connect to any one of the plurality of independent stations.

18. The firefighting system of claim 14, further including a third hose which is adapted to couple the portable pressurized tank to the second hose.

19. A method of making a firefighting system for use in filling portable pressurized tanks, comprising:

providing a first hose for transporting a firefighting compound;

providing a second hose mounted external to the first hose along an entire length of the first hose for transporting pressurized gas; and providing a plurality of quick release connectors coupled to exit points along the second hose and spaced apart at predetermined intervals substantially along an entire length of the first hose, wherein the portable pressurized tanks are connectable to each one of the plurality of quick release connectors for receiving the pressurized gas from the second hose at sufficient pressure to fill the portable pressurized tank.

20. The method of claim 19, further including providing a sheath to encase the first and the second hose.

21. The method of claim 19, further including providing a third hose which is adapted to couple the portable pressurized tank to the second hose.

* * * * *